US007025394B1

(12) United States Patent
Hunt

(10) Patent No.: US 7,025,394 B1
(45) Date of Patent: Apr. 11, 2006

(54) LOCK SYSTEM FOR INTEGRATING INTO AN ENTRY DOOR HAVING A VERTICAL EXPANSE AND PROVIDING SIMULTANEOUS MULTI-POINT LOCKING ALONG THE VERTICAL EXPANSE OF THE ENTRY DOOR

(76) Inventor: Harry C. Hunt, 122 Calistoga Rd., #245, Santa Rosa, CA (US) 95409

( * ) Notice: Subject to any disclaimer, the term of this patent is extended or adjusted under 35 U.S.C. 154(b) by 0 days.

(21) Appl. No.: 11/088,195

(22) Filed: Mar. 23, 2005

(51) Int. Cl.
*E05C 1/06* (2006.01)

(52) U.S. Cl. ..... 292/39; 292/22; 292/142; 292/157; 292/160; 292/172; 292/279; 70/103; 70/113; 70/118; 70/190; 70/191

(58) Field of Classification Search ..... 292/39, 292/22, 32, 33, 38, 138, 141, 142, 157, 160, 292/171, 172, 279; 70/103, 113, 118, 120, 70/130, 190, 191
See application file for complete search history.

(56) References Cited

U.S. PATENT DOCUMENTS

| | | | | | |
|---|---|---|---|---|---|
| 813,455 | A | * | 2/1906 | Scheel | 49/178 |
| 1,251,467 | A | * | 1/1918 | Blixt et al. | 109/61 |
| 1,341,038 | A | * | 5/1920 | Bickel | 70/116 |
| 1,545,962 | A | * | 7/1925 | Klein | 70/118 |
| 1,900,503 | A | * | 3/1933 | Kemp | 292/33 |
| 2,721,092 | A | * | 10/1955 | Simmons | 292/172 |
| 2,787,154 | A | * | 4/1957 | Wesberry | 70/118 |
| 2,862,750 | A | * | 12/1958 | Minke | 292/172 |
| 3,308,579 | A | * | 3/1967 | Thams | 49/192 |
| 3,390,558 | A | | 7/1968 | Tornoe | |
| 3,791,180 | A | * | 2/1974 | Doyle | 70/107 |
| 3,806,171 | A | * | 4/1974 | Fernandez | 292/39 |
| 4,156,541 | A | | 5/1979 | Babb, Jr. | |
| 4,227,723 | A | | 10/1980 | Rosell | |
| 4,353,582 | A | | 10/1982 | Eigemeier | |
| 4,384,465 | A | * | 5/1983 | Muus | 70/129 |
| 4,671,089 | A | | 6/1987 | Fleming | |
| 4,717,185 | A | | 1/1988 | Hartley | |
| 4,861,079 | A | | 8/1989 | DeForrest, Sr. | |
| 4,885,921 | A | | 12/1989 | Sharav | |
| 4,921,122 | A | | 5/1990 | Bornstein et al. | |
| 4,962,653 | A | | 10/1990 | Kaup | |
| 5,003,796 | A | | 4/1991 | Tom | |

(Continued)

FOREIGN PATENT DOCUMENTS

FR 2667105 * 3/1992

*Primary Examiner*—Brian E. Glessner
*Assistant Examiner*—Carlos Lugo
(74) *Attorney, Agent, or Firm*—Bernard S. Hoffman

(57) ABSTRACT

A lock system for integrating into an entry door having a vertical expanse and providing simultaneous multi-point locking along the vertical expanse of the entry door. The lock system includes a plurality of conventional deadbolt assemblies, a plurality of pinion gears, and a rack gear. The plurality of conventional deadbolt assemblies are positioned along the vertical expanse of the entry door. The plurality of pinion gears are operatively connected to the plurality of conventional deadbolt assemblies, respectively. The rack gear is operatively connected to the plurality of pinion gears so as to allow the plurality of pinions gears to operate simultaneously and form simultaneously operated pinion gears. The simultaneously operated pinion gears simultaneously operate the plurality of conventional deadbolt assemblies to provide simultaneous multi-point locking along the vertical expanse of the entry door.

18 Claims, 4 Drawing Sheets

U.S. PATENT DOCUMENTS 5,058,938 A 10/1991 Doring
5,067,755 A * 11/1991 James ..... 292/33
5,077,992 A 1/1992 Su
5,094,483 A * 3/1992 James ..... 292/39
5,201,200 A 4/1993 Hauber
5,290,077 A 3/1994 Fleming
5,394,178 A * 2/1995 Grange ..... 347/32
5,404,737 A * 4/1995 Hotzl ..... 70/279.1
5,470,115 A 11/1995 Berg et al.
5,490,695 A 2/1996 Shiue
5,496,082 A * 3/1996 Zuckerman ..... 292/336.3
5,524,941 A 6/1996 Fleming
5,551,263 A 9/1996 Myers et al.
5,707,090 A * 1/1998 Sedley ..... 292/172
5,794,844 A 8/1998 Jenkins
5,826,922 A * 10/1998 Wernig ..... 292/39
5,878,606 A 3/1999 Chaput et al.
5,911,763 A 6/1999 Quesada
5,975,592 A 11/1999 Lin
6,023,952 A * 2/2000 Mantarakis et al. ..... 70/99
6,116,662 A * 9/2000 Johnson ..... 292/142
6,151,935 A 11/2000 Evans et al.
6,178,700 B1 1/2001 Mayer, Jr.
6,217,087 B1 * 4/2001 Fuller ..... 292/39
6,557,912 B1 5/2003 Truong

* cited by examiner

LOCK SYSTEM FOR INTEGRATING INTO AN ENTRY DOOR HAVING A VERTICAL EXPANSE AND PROVIDING SIMULTANEOUS MULTI-POINT LOCKING ALONG THE VERTICAL EXPANSE OF THE ENTRY DOOR

BACKGROUND OF THE INVENTION

1. Field of the Invention

The present invention relates to a lock system for an entry door, and more particularly, the present invention relates to a lock system for integrating into an entry door having a vertical expanse and providing simultaneous multi-point locking along the vertical expanse of the entry door.

2. Description of the Prior Art

Currently manufactured residential entry doors provide limited protection from forced entry. Typically, entry doors are constructed of wood, fiberglass, or steel laminate over press board. These doors provide locking through a single deadbolt and latch from the door handle.

The deadbolt and latch, when extended, passes through metal door strikes which are screwed into the doorjamb. These strikes are usually fastened to the jamb with ⅞" wood screws for a latching strike and 3" wood screws for a deadbolt strike.

The jamb is fastened to the structure rough opening with 2½" wood screws on the jamb and hinge sides thereof. The jam is typically /3;4" thick finger jointed pine wood.

Forced entry through residential doors is accomplished by applying force to the locking area by foot, which dislodges the deadbolt and the latch from the strikes. Typically, the door itself sustains little or no damage. Kicking a door in can be done by 2 or 3 kicks.

To remedy a force entry problem, many residences purchase aftermarket locking devices, such as surface mounted locks or chains. These provide little or no additional protection and are rather unsightly when seen from the inside.

Some residences purchase a steel security door. These steel doors mount in front of the existing door and are fundamentally effective in stopping or delaying forced entry by providing a primary layer of protection from the main door.

Steel security doors, however, cost from $200.00 and can rust, causing a maintenance issue. They also require the resident to unlock up to four locks to gain entry, and aesthetically, they are not very attractive to look at.

Some new wood, fiberglass, and steel entry doors are very attractive. Many have leaded glass features and cost upwards of $2,500.00. Why would a homeowner want to cover up his or her new, beautiful, expensive entry door if not for the fear of someone kicking it in to gain entry?

Thus, there exists a need for a locking system that minimizes forced entry through residential doors, is not unsightly, will not rust, and does not require the resident to unlock multiple locks to gain entry.

Numerous innovations for locks have been provided in the prior art that will be described infra. Even though these innovations may be suitable for the specific individual purposes to which they address, they each differ in structure and/or operation and/or purpose from the present invention in that they do not teach a lock system for integrating into an entry door having a vertical expanse and providing simultaneous multi-point locking along the vertical expanse of the entry door.

FOR EXAMPLE, U.S. Pat. No. 3,390,558 to Tornoe teaches a high security lock for mounting on a door panel having a latch bolt and a deadbolt with inner and outer knobs to reciprocate the latch bolt and an inner thumb turn and an outer key mechanism to reciprocate the deadbolt.

ANOTHER EXAMPLE, U.S. Pat. No. 4,156,541 to Babb Jr. teaches an interconnecting lock assembly having simultaneously actuated, multiple security deadbolts. A central one forms part of the main lock subassembly, and the others are operated from the main lock subassembly through a special mechanism.

STILL ANOTHER EXAMPLE, U.S. Pat. No. 4,227,723 to Rosell teaches a latch that includes a case containing a mechanism for actuating a half-turn bolt, and a head plate. At least one half-turn bolt is provided which is mounted to be movable in a direction parallel to the plane of the head plate of the latch.

YET ANOTHER EXAMPLE, U.S. Pat. No. 4,353,582 to Eigemeier teaches a door lock with two case parts disposed in parallel opposed relationship. The follower, designed as an injection molded synthetic resin part, is resilient in itself owing to a supported follower portion. The spring for the spring bolt and for the tumbler are formed by a base structure and the support for a fitting to be mounted later on is offered by sleeves which are provided above and below the follower, both at the lock case bottom and at the inside of the lock cover. The spring-like action of the follower is achieved in that the bent follower leg slidingly bears against an inclined supporting surface of an abutment while curving inwardly or outwardly upon radial movement of the follower. Good fit of the lock in the pocket provided in the door is achieved by ribs on the outer surfaces of the lock case. The lock with all its interior parts is fabricated from thermoplastic synthetic resin material.

STILL YET ANOTHER EXAMPLE, U.S. Pat. No. 4,671,089 to Fleming teaches a combination door latch and deadbolt assembly that includes a mechanism and a deadbolt mechanism designed for use with doors having a variety of standard size backset and cross bore dimensions. The latch and the deadbolt mechanisms are carried by escutcheons having breakaway tabs at varying diametric positions to fit securely within door cross bores of different standard sizes. The latch mechanism further includes a mounting arrangement for left- or right-hand mounting and positive centering of lever-type door handles, together with a simplified cam-actuated latch retractor. The deadbolt mechanism includes a bolt linkage which provides a desired bolt throw when a relatively small door backset and/or cross bore size is used. The deadbolt mechanism further includes a thumb turn rotatable through ninety degrees between orientations representative of the deadbolt position.

YET STILL ANOTHER EXAMPLE, U.S. Pat. No. 4,717,185 to Hartley teaches a security striker plate for a lock assembly upon a door hinged within a doorjamb including a peripheral door stop and interior framing studs that includes a unit body of U-shape including spaced inner and outer mount plates snugly positioned upon the studs and apertured for nailing thereto. A right angular apertured strike plate extends from the inner mount plate, faces the door when closed, and terminates in a right angular door stop lip nested within the door stop and the doorjamb. An anchor plate extending from the lip and underlying the doorjamb is retained thereby and is connected to the outer mount plate.

STILL YET ANOTHER EXAMPLE, U.S. Pat. No. 4,861,079 to DeForrest Sr. teaches a multi-purpose lock bolt that has a body which includes a bolt hole, a lock shackle hole, and one or more mounting holes. Each of these are formed in the body and pass through the body. The lock shackle hole intersects with, and traverses across, the bolt hole, as do the mounting holes. An elongated bolt is sized and shaped so as to fit into, and slide in, the bolt hole. The elongated bolt includes an alignment hole which is located in the elongated bolt in a direction transverse to the elongated axis of the elongated bolt. The bolt slides in the bolt hole in the body between an unlocked position and a locked position. In the locked position, the alignment hole in the elongated bolt is aligned with the lock shackle hole in the body allowing a shackle of a lock to be passed through both the lock shackle hole of the body and the alignment hole in the elongated bolt to fix the elongated bolt with respect to the body in a locked position.

YET STILL ANOTHER EXAMPLE, U.S. Pat. No. 4,885, 921 to Sharav teaches a cover for various locks that are often placed a few inches above the door-knob. The cover is an elongated plate spaced from the door and has sidewalls extending almost to the door. The cover has a downwardly extending portion that surrounds the shaft of the door-knob, has a hole through the shaft of the door-knob, and has a hole through which the door-knob passes when the cover is rotated on its hinges to an open position. A jamming device has an indent for receiving the key or handle of one of the locks on the door. The jamming device bears against the shaft of the door-knob and prevents the key or handle of the lock from turning. Hence, the lock remains locked when the jamming device is used.

STILL YET ANOTHER EXAMPLE, U.S. Pat. No. 4,921, 122 to Bornstein et al. teaches a slide bar locking arrangement for securing a lid to a cabinet to prevent unauthorized access. Hook members extending from the underside of the lid are received in, and engage, a plurality of corresponding apertures defined in a resiliently biased slide bar slidably mounted adjacent an inner wall of the cabinet, thereby securing the lid to the cabinet. During closing of the lid, the sides of the hook members contact the sides of the apertures causing the slide bar to move laterally until the hooks are secured in the apertures. A knob attached to the slide bar extends outside the cabinet and is operable to move the slide bar out of engagement with the hook members so that the lid may be opened. A lock mechanism is provided to secure the slide bar against movement so that the lid cannot be opened until the lock mechanism is unlocked.

YET STILL ANOTHER EXAMPLE, U.S. Pat. No. 4,962, 653 to Kaup teaches a drive rod lock. The drive rod is moved from a lock cylinder through a step-down gearing between an open position and a closed position and vice versa. A coupling of the step-down gearing to the drive rod is proposed which permits, in the case of rotation of the lock cylinder through 2 degrees to 360 degrees, shifting the drive rod from the open position into the closed position against displacement without a torque being introduced due to the blocking forces into the step-down gearing and thus the lock cylinder.

STILL YET ANOTHER EXAMPLE, U.S. Pat. No. 5,003, 796 to Tom teaches a door lock which includes a first bolt mounted movably in a housing and biased to a latching position, and an elongated second bolt member lying in a vertical plane and mounted movably below the first bolt. A first actuating plate is provided adjacent the first notched face and turnable about a horizontal axis to push the notched face so that the second bolt is moved to a latching position or an unlatching position. A first locking plate is cooperatively associated with the second bolt and biased to move upward to a position in which the first locking plate locks the second bolt against movement. The second bolt member further has a second notched face in the upper end near the rear end of the second bolt member, and a second actuating plate is provided adjacent to the second notched face to push the second notched face so as to move the second bolt member.

YET STILL ANOTHER EXAMPLE, U.S. Pat. No. 5,058, 938 to Döring teaches a drive-rod lock that has drive rods which can be displaced by turning a door handle or the like, and a nut associated with the door handle. The nut, held in its basic central position, can be swung out of that position against spring action in the opposite direction. The lock case bears a cuff rail which continues beyond the lock case into freely extending cuff-rail sections behind which there are guided drive rods. The drive rods control additional lock members, for instance swivel bolts, arranged in the region of the cuff-rail sections. These locking members operate both by the turning of the door handle and as a result of release of at least one force accumulator acting on the drive rods. Operation is obtained by means of a release which is actuated upon the closing of the door by the frame or the like, and for a favorable positioning of the release even with a small depth of the drive-rod lock. The release and/or the force accumulator are/is arranged behind the freely extending cuff-rail sections.

STILL YET ANOTHER EXAMPLE, U.S. Pat. No. 5,077, 992 to Su teaches a door lock that includes a driving cam secured to a first spindle operatively retracting a latch, a follower cam secured to a second spindle operatively retracting a deadbolt, and a linking rod having a first pin formed on a rod end pivotally connected with a cam protrusion formed on the driving cam and having a second pin formed on the other rod end slidably moving in an arcuate slot in the follower cam, whereby upon a rotation of an inside knob for rotating the driving cam for retracting the latch, the linking rod will be biased to pull the follower cam for rotating the follower cam to retract the deadbolt for simultaneously retracting both the deadbolt and the latch for opening a door.

YET STILL ANOTHER EXAMPLE, U.S. Pat. No. 5,201, 200 to Hauber teaches an entry lock assembly including a deadbolt incrementally extendible by successive turns of a key, a slam bolt which is bodily reversible and blocked against retraction by the deadbolt when extended, and a lock face plate which is bodily reversible for rehanding the lock.

STILL YET ANOTHER EXAMPLE, U.S. Pat. No. 5,290, 077 to Fleming teaches a door lock assembly for multipoint locking of a door. The lock assembly includes a main lock cartridge in combination with one or more remote secondary lock cartridges mounted at one side edge of a door. The main lock cartridge has an actuator for manipulating a plurality of lock members. In one preferred form for use with a hinged or swinging door, the lock members include a plurality of latch bolts movable to a first extended position for normal door latching or to a second and further extended position to function as multiple deadbolts. In an alternate preferred form for use with a sliding door, the lock members include headed latch pins for engaging keeper plates on the adjacent door jamb. In either embodiment, the doorjamb may include the adjacent side edge of a second or semi-active door in a double door entry set. The second door desirably includes a header-sill lock assembly which is maintained in a positively locked condition unless the adjacent door is opened.

YET STILL ANOTHER EXAMPLE, U.S. Pat. No. 5,470, 115 to Berg et al. teaches a recessed three-point latching mechanism and method for a storage locker and a locker incorporating the same that utilizes a deadbolt system employing a pair of rotary actuated lock rods for engaging the top and bottom of the locker door opening in conjunction with a center latch engaging the door jamb. A lever, which may include a finger grip, is utilized for simultaneously unlocking the lock rods, unlatching the center latch, and is accessible within a recessed cup. The latching mechanism and method may also include a cam to hold the latching mechanism in a door open position until the door is closed to prevent damage to the locker face by the otherwise extended lock rods. The latching mechanism and method is compatible with either padlocks or a built-in lock secured within the recessed cup.

STILL YET ANOTHER EXAMPLE, U.S. Pat. No. 5,490, 695 to Shiue teaches a door lock that includes a deadbolt slidably received in a lock case and having a pair of extensions extended outward beyond the lock case. A pair of plates are fixed to the lock case and each has an oblong hole. An actuating wheel is slidably engaged in the oblong holes and includes a pair of teeth for engaging with the extensions. A board is disposed between the plates and has two bulges for forcing the actuating wheel toward one of the plates so as to retain the actuating wheel in place. A resilient member has a throat portion for positioning the actuating wheel in either end of the oblong holes.

YET STILL ANOTHER EXAMPLE, U.S. Pat. No. 5,524, 941 to Fleming teaches a door lock assembly for multipoint locking of a door. The lock assembly includes a main lock cartridge in combination with one or more remote secondary lock cartridges mounted at one side edge of a door. The main lock cartridge has an actuator for manipulating a plurality of lock members. In one preferred form for use with a hinged or swinging door, the lock members include a plurality of latch bolts movable to a first extended position for normal door latching or to a second and further extended position to function as multiple deadbolts. In an alternate preferred form for use with a sliding door, the lock members include headed latch pins for engaging keeper plates on the adjacent door jamb. In either embodiment, the doorjamb may include the adjacent side edge of a second or semi-active door in a double door entry set. The second door desirably includes a header-sill lock assembly which is maintained in a positively locked condition unless the adjacent door is opened.

STILL YET ANOTHER EXAMPLE, U.S. Pat. No. 5,551, 263 to Myers et al. teaches a standard "diamond back" lock configuration, as used in drawer locks, that includes a deadbolt with an angled slot. The angled slot provides a camming action which produces the same amount of linear deadbolt motion with 90 degrees of lock plug rotation as a conventional, non-angled slot with 180 degrees of rotation. In addition, since only 90 degrees of rotation is necessary to fully extend or retract the deadbolt, a user can ascertain whether the lock is engaged or not by the relative orientation of the keyway entry. Also, with 90 degrees of lock plug rotation, key retention at the unlocked position can be provided as an added feature of the lock.

YET STILL ANOTHER EXAMPLE, U.S. Pat. No. 5,794, 844 to Jenkins teaches a multiple point latching system for use with postal box clusters. In particular, the multiple point latching system includes a latch bar, a track member, a plunger assembly, and a plurality of latch plates. The latch bar is slidably coupled relative to a center partition in the postal box and includes a plurality of latches thereon. The latch bar slides in a vertical movement within a track member which is coupled to the center partition of the postal box. The plurality of latches on the latch bar present a plurality of latch points which aggregate to achieve the securement of the postal box cluster. The multiple point latching system further includes a plunger assembly which is coupled to the center partition, and which supplies a force that acts upon at least one master door to thereby force at least one master door open upon an unlatching of the latches. Hence, a single lock having multiple latch points is used to access and subsequently secure the entire postal box cluster.

STILL YET ANOTHER EXAMPLE, U.S. Pat. No. 5,878, 606 to Chaput teaches a deadbolt lock system for a swinging door which prevents movement of the deadbolts from a locked position to an unlocked position when the door is open. Movement of the deadbolts from an unlocked to a locked position when the door is opened is prevented by a slide plate which is locked into a deadbolt deactivating position by a plunger which is biased outward when the door is opened. The system also provides for an unlocking of the deadbolts and an opening of the door with a single rotation of the inside handle.

YET STILL ANOTHER EXAMPLE, U.S. Pat. No. 5,911, 763 to Quesada teaches a three point lock mechanism that includes a lower deadbolt which respectively engages the threshold and lintel of a door or other hinged panel in addition to the central jamb deadbolt. The mechanism utilizes a conventional deadbolt lock set for the central jamb deadbolt. A generally circular plate is attached to the lock set to rotate therewith when the lock is turned to lock or unlock the door. An upper and a lower deadbolt actuation rod extend from the plate and serve to actuate respectively the upper and lower deadbolts of the system by a pivoting actuator at each deadbolt. The two rods are pivotally secured to the plate 135 degrees from one another in order to provide an overcenter weight bias of the rods to urge the upper and lower deadbolts to a retracted position when retracted and to an extended position when extended. The rods are each secured to the plate at a different radius from the center of the plate in order to provide equal linear travel distances for the rods and deadbolts due to the different arcuate positions of the rod attachment points.

STILL YET ANOTHER EXAMPLE, U.S. Pat. No. 5,975, 592 to Lin teaches a lock assembly including a housing, a control mechanism, one pin or two pins supported by the housing for shifting movement of the pin or of the two pins in a direction transverse to the direction of movement of the control mechanism between a locked position and an unlocked position, and a spring for each pin for enhancing the shifting movement of the corresponding pin toward the unlocked position and for automatically returning the corresponding pin toward the locked position upon release of the control mechanism. When the control mechanism is pushed manually, the pressure which is exerted upon pushing the control mechanism compresses the spring around the pin or two pins which each shifts in a direction transverse to the direction of movement of the control mechanism between the locked position and the unlocked position. Meanwhile, shifting of the pin or of the two pins permits the sliding of a cut-out section of the control mechanism until the pin or two pins strike against the cut-out sections of the control mechanism. As soon as the movement is stopped, the pin or two pins which are acted on by the spring assume a position which assures locking. As soon as the control mechanism is released, the pin or two pins immediately and automatically return to the locked position again.

YET STILL ANOTHER EXAMPLE, U.S. Pat. No. 6,151, 935 to Evans et al. teaches a deadbolt lock and a deadbolt which will extend automatically whenever a container is locked by virtue of a rigid portion of the container engaging a trigger element extending from the end face of the bolt and causing the release of an outer bolt portion. The release of the outer bolt of the bolt assembly allows the outer bolt to project outwardly and to lock the container notwithstanding the fact that the bolt has not been reset by the operator of the lock. The bolt is self-contained and can be substituted into many existing lock mechanisms of the mechanical type and into some of the existing electronic dial combination locks to provide auto-locking.

STILL YET ANOTHER EXAMPLE, U.S. Pat. No. 6,178,700 to Mayer Jr. teaches an apparatus for reinforcing a door frame that includes a pair of elongated metal plates extending substantially the length and width of the jambs forming either side of the door frame. Each of the metal plates defines a plurality of attachment holes for attaching the plates individually to the back sides of each of the jambs with fasteners passing therethrough. In addition, each plate defines a plurality of installation holes for allowing the door frame to be secured in the framed opening. Fasteners pass through the jambs, the installation holes, and into adjacent members of the framed opening. Each plate further defines a plurality of openings along the lengths thereof which allow attachment of appropriate hinges or strike plate to the front side of the corresponding jamb by fasteners passing through the hinges or strike plate, the jamb, the openings, and into an adjacent member of the framed opening.

YET STILL ANOTHER EXAMPLE, U.S. Pat. No. 6,557,912 to Truong teaches an apparatus for holding a door. The apparatus includes a body member configured to be coupled to a floor. Further, the apparatus includes a locking member movably coupled to the body member and having an end that is configured to engage the door. Further still, the apparatus includes a stop arrangement coupled to the locking member and configured to hold the locking member in a predetermined position relative to the body member. The predetermined position is associated with a predefined door position such that the holding prevents the door from moving past a predefined door position when the locking member is engaged with the door.

It is apparent that numerous innovations for locks have been provided in the prior art that are adapted to be used. Furthermore, even though these innovations may be suitable for the specific individual purposes to which they address, they would not be suitable for the purposes of the present invention as heretofore described, namely, a lock system for integrating into an entry door having a vertical expanse and providing simultaneous multi-point locking along the vertical expanse of the entry door.

SUMMARY OF THE INVENTION

ACCORDINGLY, AN OBJECT of the present invention is to provide a lock system for integrating into an entry door having a vertical expanse and providing simultaneous multi-point locking along the vertical expanse of the entry door that avoids the disadvantages of the prior art.

ANOTHER OBJECT of the present invention is to provide a lock system for integrating into an entry door having a vertical expanse and providing simultaneous multi-point locking along the vertical expanse of the entry door that is simple to use.

STILL ANOTHER OBJECT of the present invention is to provide a lock system for integrating into an entry door having a vertical expanse and providing simultaneous multi-point locking along the vertical expanse of the entry door that improves security.

BRIEFLY STATED, YET ANOTHER OBJECT of the present invention is to provide a lock system for integrating into an entry door having a vertical expanse and providing simultaneous multi-point locking along the vertical expanse of the entry door. The lock system includes a plurality of conventional deadbolt assemblies, a plurality of pinion gears, and a rack gear. The plurality of conventional deadbolt assemblies are positioned along the vertical expanse of the entry door. The plurality of pinion gears are operatively connected to the plurality of conventional deadbolt assemblies, respectively. The rack gear is operatively connected to the plurality of pinion gears so as to allow the plurality of pinions gears to operate simultaneously and form simultaneously operated pinion gears. The simultaneously operated pinion gears simultaneously operate the plurality of conventional deadbolt assemblies to provide simultaneous multi-point locking along the vertical expanse of the entry door.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
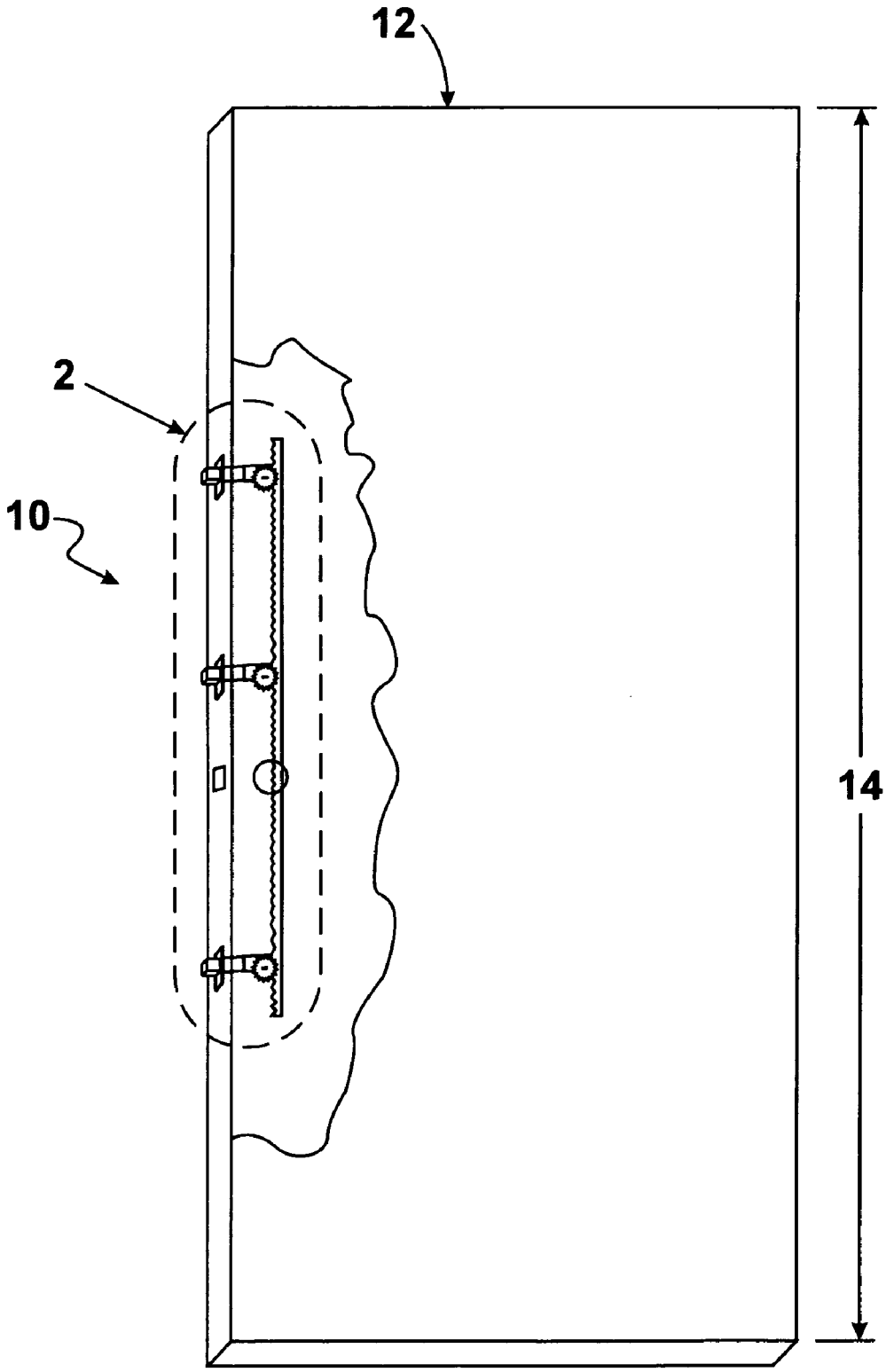
FIG. 1 is a diagrammatic perspective view of the lock system of the present invention integrated into an entry door having a vertical expanse and providing simultaneous multi-point locking along the vertical expanse of the entry door.

10 lock system of present invention for integrating into entry door 12 having vertical expanse 14 and providing simultaneous multi-point locking along vertical expanse 14 of entry door 12

12 entry door

14 vertical expanse of entry door 12

16 plurality of conventional deadbolt assemblies for positioning along vertical expanse 14 of entry door 12

18 plurality of pinion gears

20 rack gear

22 simultaneously operated pinion gears

24 plurality of connecting rods

26 pair of terminal ends of each connecting rod of plurality of connecting rods 24

28 rotating cam actuator of each conventional deadbolt assembly of plurality of conventional deadbolt assemblies 16

30 through slot in rotating cam actuator 28 of each conventional deadbolt assembly of plurality of conventional deadbolt assemblies 16

32 through slot in each pinion gear of plurality of pinion gears 18

34 pair of through bores in pair of terminal ends 26 of each connecting rod of plurality of connecting rods 24, respectively

36 plurality of pairs of fasteners

38 exterior keyed deadlock

40 thumb latch

DETAILED DESCRIPTION OF THE PREFERRED EMBODIMENT

Referring now to the figures, in which like numerals indicate like parts, and particularly to FIG. 1, which is a diagrammatic perspective view of the lock system of the present invention integrated into an entry door having a vertical expanse and providing simultaneous multi-point locking along the vertical expanse of the entry door, the lock system of the present invention is shown generally at 10 for integrating into an entry door 12 having a vertical expanse 14 and providing simultaneous multi-point locking along the vertical expanse 14 of the entry door 12.

Figure 2:
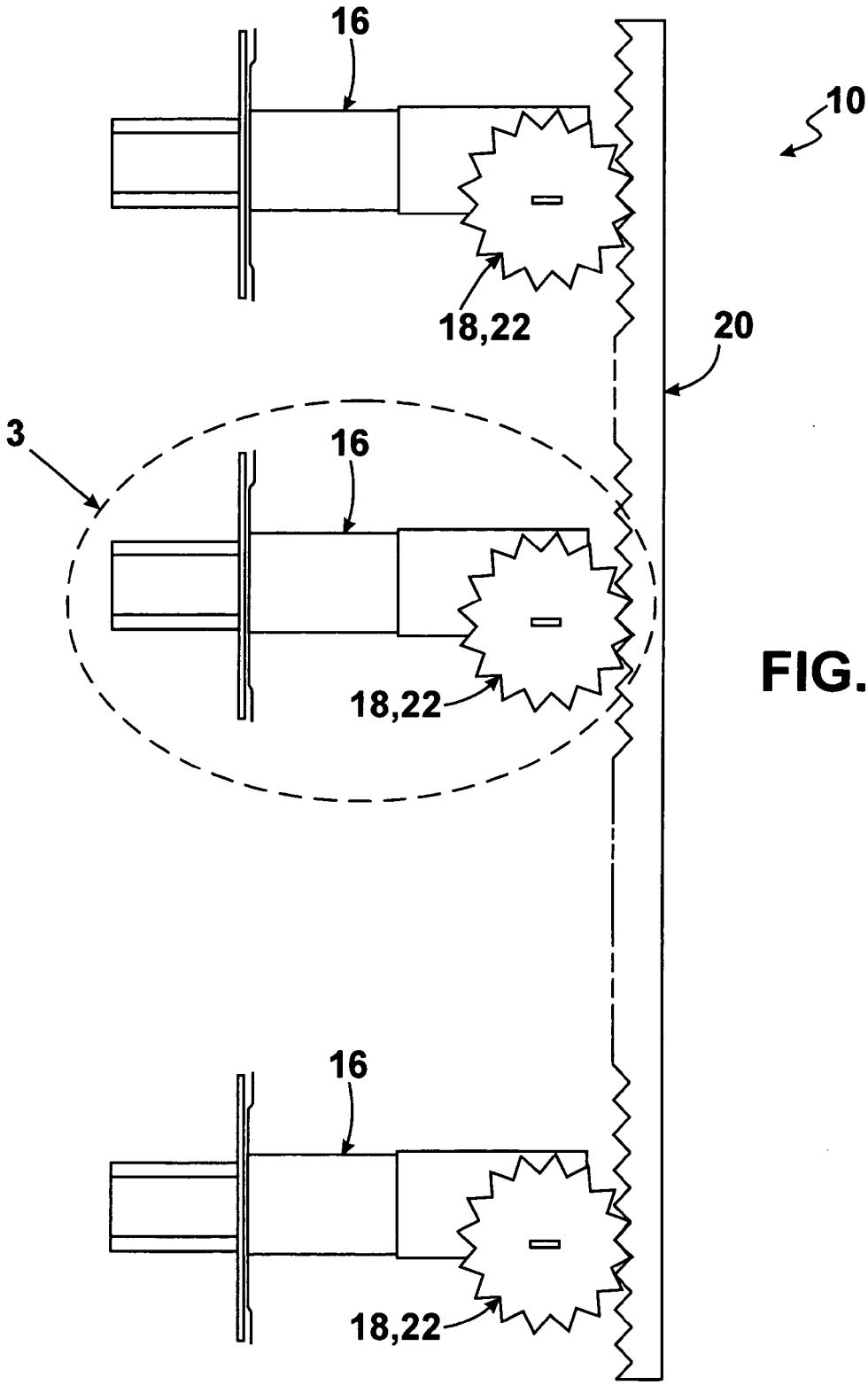
FIG. 2 is an enlarged diagrammatic front elevational view of the area generally enclosed by the dotted curve identified by ARROW 2 in FIG. 1 of the lock system of the present invention.

The overall configuration of the lock system 10 can best be seen in FIG. 2, which is an enlarged diagrammatic front elevational view of the area generally enclosed by the dotted curve identified by ARROW 2 in FIG. 1 of the lock system of the present invention, and as such, will be discussed thereto.

The lock system 10 comprises a plurality of conventional deadbolt assemblies 16, a plurality of pinion gears 18, and a rack gear 20. The plurality of conventional deadbolt assemblies 16 are preferably spaced-apart and coplanar and are for positioning along the vertical expanse 14 of the entry door 12. The plurality of pinion gears 18 are operatively connected to the plurality of conventional deadbolt assemblies 16, respectively. The rack gear 20 is operatively connected to the plurality of pinion gears 18 so as to allow the plurality of pinions gears 18 to operate simultaneously and form simultaneously operated pinion gears 22. The simultaneously operated pinion gears 22 simultaneously operate the plurality of conventional deadbolt assemblies 16 for providing simultaneous multi-point locking along the vertical expanse 14 of the entry door 12.

Figure 3:
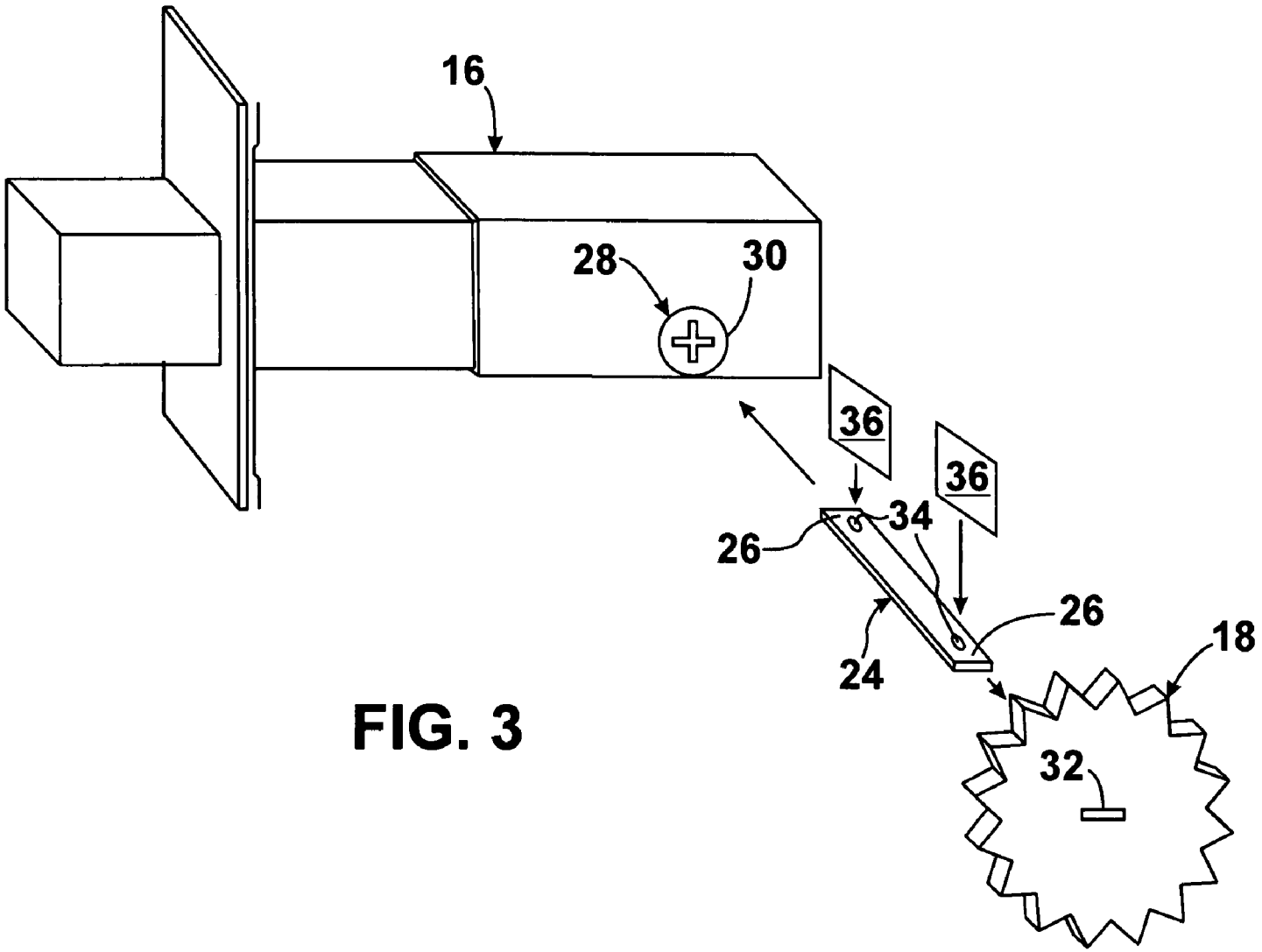
FIG. 3 is an enlarged exploded diagrammatic perspective view of the area generally enclosed by the dotted curve identified by ARROW 3 in FIG. 2.

The specific configuration of the interface of each pinion gear 22 and its associated conventional deadbolt assembly 16 can best be seen in FIG. 3, which is an enlarged exploded diagrammatic perspective view of the area generally enclosed by the dotted curve identified by ARROW 3 in FIG. 2, and as such, will be discussed with reference thereto.

The lock system 10 further comprises a plurality of connecting rods 24. Each connecting rod 24 is preferably flat and operatively connects each pinion gear 18 to an associated conventional deadbolt assembly 16, and has a pair of terminal ends 26.

Each conventional deadbolt assembly 16 has a rotating cam actuator 28 with a through slot 30, and each pinion gear 18 has a through slot 32. One terminal end 26 of each connecting rod 24 engages in the through slot 30 in the rotating cam actuator 28 of an associated conventional deadbolt assembly 16 and the other terminal end 26 of each connecting rod 24 engages in the through slot 32 in an associated pinion gear 18 so as to allow each connecting rod 24 to operatively connect each pinion gear 18 to an associated conventional deadbolt assembly 16.

The pair of terminal ends 26 of the plurality of connecting rods 24 have a pair of through bores 34 therethrough, respectively.

The lock system 10 further comprises a plurality of pairs of fasteners 36, such as cotter pins, screws, rivets, etc. One fastener 36 enters the through bore 34 in one terminal end 26 of each connecting rod 24 after passing through the through slot 30 in the rotating cam actuator 28 of an associated deadbolt assembly 16 and the other fastener 36 enters the through bore 34 in the other terminal end 26 of each connecting rod 24 after passing through the through slot 32 in an associated pinion gear 18 so as to prevent each connecting rod 24 from unintentionally leaving an associated conventional deadbolt 16 and an associated pinion gear 18.

Figure 4:
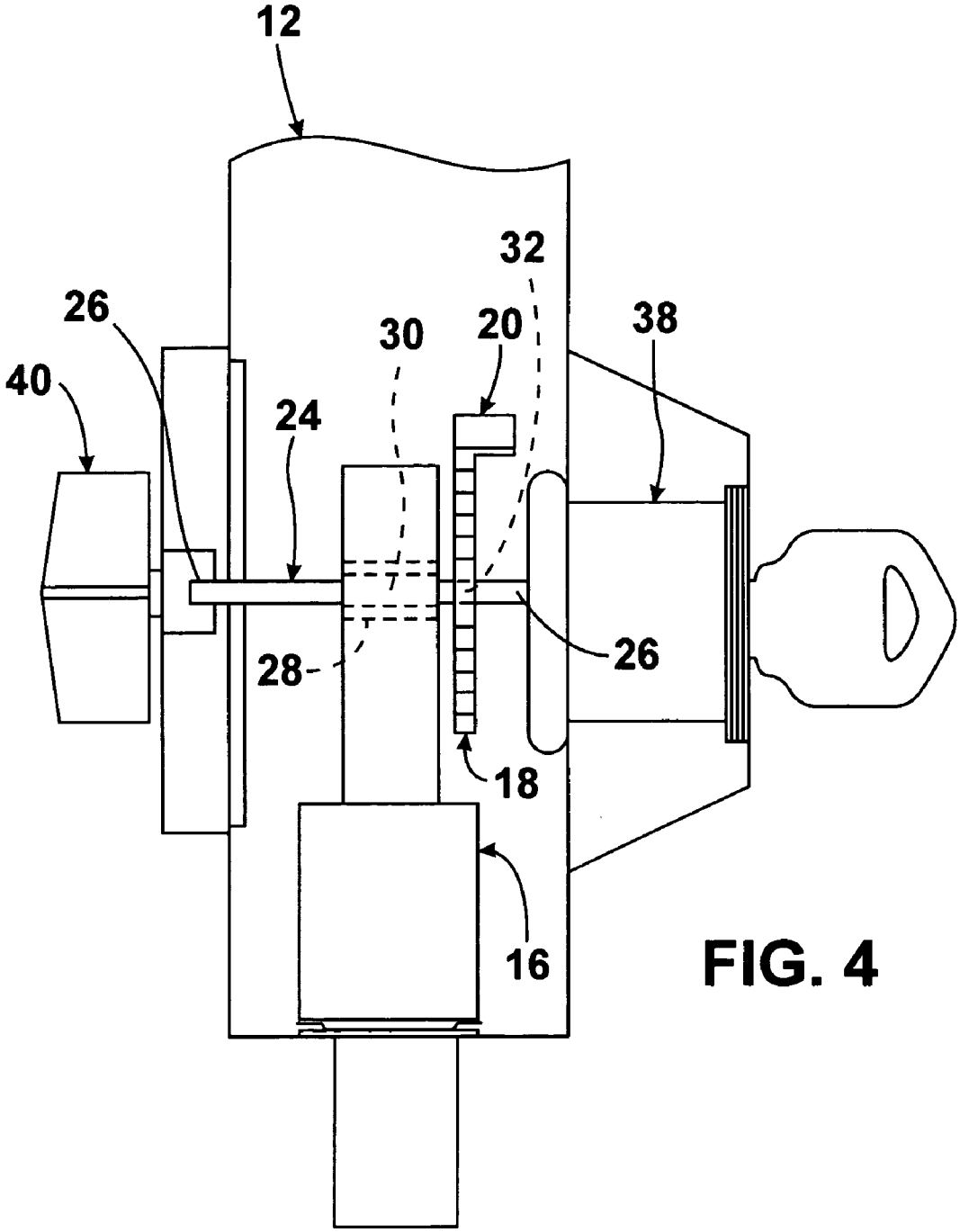
FIG. 4 is a diagrammatic top plan view of one conventional deadbolt assembly of the lock system of the present invention and its associated pinion gear of the lock system of the present invention integrated into the entry door and operatively connected to an exterior keyed deadlock and to a thumb latch.

As shown in FIG. 4, which is a diagrammatic top plan view of one conventional deadbolt assembly of the lock system of the present invention and its associated pinion gear of the lock system of the present invention integrated into the entry door and operatively connected to an exterior keyed deadlock and to a thumb latch, the lock system 10 further comprises an exterior keyed deadlock 38 and a thumb latch 40. One connecting rod 24 passes through the through slot 30 in the rotating cam actuator 28 of one conventional deadbolt assembly 16 and through the through slot 32 in an associated pinion gear 18, with one terminal end 26 thereof passing through the entry door 12 and engaging the exterior keyed deadlock 38, with the other terminal end 26 thereof passing through the entry door 12 and engaging the thumb latch 40, and with the associated pinion gear 18 operatively engaging the rack gear 20 so as to allow either of the exterior keyed deadlock 38 or the thumb latch 40 to lock the rack gear 20 and the simultaneously operated pinion gears 22 operatively connected thereto, thereby locking the plurality of conventional deadbolt assemblies 16 operatively connected thereto.

It will be understood that each of the elements described above, or two or more together, may also find a useful application in other types of constructions differing from the types described above.

While the invention has been illustrated and described as embodied in a lock system for integrating into an entry door having a vertical expanse and providing simultaneous multi-point locking along the vertical expanse of the entry door, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A lock system for integrating into an entry door having a vertical expanse and providing simultaneous multi-point locking along the vertical expanse of the entry door, said lock system comprising:

a) a plurality of conventional deadbolt assemblies;

b) a plurality of pinion gears;

c) a rack gear; and d) a plurality of connecting rods;

wherein said plurality of conventional deadbolt assemblies are for positioning along the vertical expanse of the entry door;

wherein said plurality of pinion gears are operatively connected to said plurality of conventional deadbolt assemblies, respectively;

wherein said rack gear is operatively connected to said plurality of pinion gears so as to allow said plurality of pinions gears to operate simultaneously and form simultaneously operated pinion gears;

wherein said simultaneously operated pinion gears simultaneously operate said plurality of conventional deadbolt assemblies for providing simultaneous multi-point locking along the vertical expanse of the entry door; and wherein each connecting rod extends substantially from a center of each pinion gear and connects each pinion gear directly to an associated conventional deadbolt assembly.

2. The lock system as defined in claim 1, wherein each connecting rod is flat.

3. The lock system as defined in claim 1, wherein each conventional deadbolt assembly has a rotating cam actuator.

4. The lock system as defined in claim 3, wherein said rotating cam actuator of each conventional deadbolt assembly has a through slot.

5. The lock system as defined in claim 4, wherein each pinion gear has a through slot.

6. The lock system as defined in claim 5, wherein each connecting rod has a pair of terminal ends; and wherein one terminal end of each connecting rod engages in said through slot in said rotating cam actuator of an associated conventional deadbolt assembly and the other terminal end of each connecting rod engages in said through slot in an associated pinion gear so as to allow each connecting rod to operatively connect each pinion gear to an associated conventional deadbolt assembly.

7. The lock system as defined in claim 6, wherein said pair of terminal ends of said plurality of connecting rods have a pair of through bores therethrough, respectively.

8. The lock system as defined in claim 7, further comprising a plurality of pairs of fasteners; and wherein one fastener enters said through bore in one terminal end of each connecting rod after passing through said through slot in said rotating cam actuator of an associated conventional deadbolt assembly and the other fastener enters said through bore in the other terminal end of each connecting rod after passing through said through slot in an associated pinion gear so as to prevent each connecting rod from unintentionally leaving an associated conventional deadbolt and an associated pinion gear.

9. The lock system as defined in claim 6, further comprising an exterior keyed deadlock; and further comprising a thumb latch.

10. The lock system as defined in claim 9, wherein one connecting rod passes through said through slot in said rotating cam actuator of one conventional deadbolt assembly and through said through slot in an associated pinion gear, with one terminal end thereof for passing through the entry door and engaging said exterior keyed deadlock, with the other terminal end thereof for passing through the entry door and engaging said thumb latch, and with said associated pinion gear operatively engaging said rack gear so as to allow either of said exterior keyed deadlock or said thumb latch to lock said rack gear and said simultaneously operated pinion gears operatively connected thereto, thereby locking said plurality of conventional deadbolt assemblies operatively connected thereto.

11. A lock system for integrating into an entry door having a vertical expanse and providing simultaneous multi-point locking along the vertical expanse of the entry door, said lock system comprising:

a) a plurality of pinion gears;

b) a rack gear; and c) a plurality of connecting rods;

wherein said plurality of pinion gears are for operatively connecting to a plurality of conventional deadbolt assemblies, respectively;

wherein the plurality of conventional deadbolt assemblies are for positioning along the vertical expanse of the entry door;

wherein said rack gear is operatively connected to said plurality of pinion gears so as to allow said plurality of pinions gears to operate simultaneously and form simultaneously operated pinion gears;

wherein said simultaneously operated pinion gears are for simultaneously operating the plurality of conventional deadbolt assemblies for providing simultaneous multi-point locking along the vertical expanse of the entry door; and wherein each connecting rod extends substantially from a center of each pinion gear and connects each pinion gear directly to an associated conventional deadbolt assembly.

12. The lock system as defined in claim 11, wherein each connecting rod is flat.

13. The lock system as defined in claim 11, wherein each pinion gear has a through slot.

14. The lock system as defined in claim 13, wherein each conventional deadbolt assembly has a rotating cam actuator;

wherein the rotating cam actuator of each conventional deadbolt assembly has a through slot;

wherein each connecting rod has a pair of terminal ends; and wherein one terminal end of each connecting rod is for engaging in the through slot in the rotating cam actuator of an associated conventional deadbolt assembly and the other terminal end of each connecting rod engages in said through slot in an associated pinion gear so as to allow each connecting rod to operatively connect each pinion gear to an associated conventional deadbolt assembly.

15. The lock system as defined in claim 14, wherein said pair of terminal ends of said plurality of connecting rods have a pair of through bores therethrough, respectively.

16. The lock system as defined in claim 15, further comprising a plurality of pairs of fasteners; and wherein one fastener enters said through bore in one terminal end of each connecting rod after passing through said through slot in said rotating cam actuator of an associated conventional deadbolt assembly and the other fastener enters said through bore in the other terminal end of each connecting rod after passing through said through slot in an associated pinion gear so as to prevent each connecting rod from unintentionally leaving an associated conventional deadbolt and an associated pinion gear.

17. The lock system as defined in claim 15, further comprising an exterior keyed deadlock; and further comprising a thumb latch.

18. The lock system as defined in claim 17, wherein one connecting rod is for passing through the through slot in the rotating cam actuator of one conventional deadbolt assembly and through said through slot in an associated pinion gear, with one terminal end thereof for passing through the entry door and engaging said exterior keyed deadlock, with the other terminal end thereof for passing through the entry door and engaging said thumb latch, and with said associated pinion gear operatively engaging said rack gear so as to allow either of said exterior keyed deadlock or said thumb latch to lock said rack gear and said simultaneously operated pinion gears operatively connected thereto, thereby locking the plurality of conventional deadbolt assemblies operatively connected thereto.

* * * * *